United States Patent [19]

Ruff

[11] 3,976,126

[45] Aug. 24, 1976

[54] AIR COOLED SURFACE CONDENSER

[75] Inventor: Klemens Ruff, Gelsenkirchen-Buer, Germany

[73] Assignee: Gea Luftkuhlergesellschaft Happel GmbH & Co. KG, Bochum, Germany

[22] Filed: Dec. 26, 1973

[21] Appl. No.: 428,403

[52] U.S. Cl. ..... 165/110; 165/151; 165/175; 165/182; 165/DIG. 1; 165/113

[51] Int. Cl.[2] ..... F28B 1/06

[58] Field of Search ..... 165/110, 111, 113, 151, 165/149, 172, 122, 124, 182, 175, DIG. 1

[56] References Cited

UNITED STATES PATENTS

| | | | |
|---|---|---|---|
| 1,805,917 | 5/1931 | Lysholm et al. | 165/151 X |
| 2,317,572 | 4/1943 | Whitt et al. | 165/172 X |
| 3,346,043 | 10/1967 | Thurnauer | 165/172 X |

FOREIGN PATENTS OR APPLICATIONS

| | | | |
|---|---|---|---|
| 124,110 | 4/1947 | Australia | 165/151 |
| 592,120 | 2/1934 | Germany | 165/110 |
| 90,653 | 1/1923 | Germany | 165/110 |

*Primary Examiner*—Albert W. Davis, Jr.
*Attorney, Agent, or Firm*—Michael J. Striker

[57] ABSTRACT

An air cooled surface consenser has a plurality of heat-exchange tubes extending transversely of the direction of air flow and each provided with heat-exchange fins. The interior of each tube is completely unobstructed and the tubes are of oval or elliptical cross section having a major interior dimension normal to their elongation which has a ratio of at least 6:1 with reference to a minor interior dimension which extends normal to the major dimension and the direction of elongation.

9 Claims, 9 Drawing Figures

AIR COOLED SURFACE CONDENSER

BACKGROUND OF THE INVENTION

The present invention relates generally to an air cooled surface condenser, and more particularly to such a surface condenser using tubes which are provided with heat-exchange fins.

Surface condensers which are air cooled are already known. They use heat-exchange tubes of flat configuration, having a cross section which is substantially rectangular so that each tube has two pairs of walls which extend in parallelism with one another. In the lower region of the tubes through which material flows from below in upward direction, various installations are accommodated in the interior of the tubes, namely in form of essentially V-shaped divider walls which subdivide the tube cross section into several separate flow channels which coverge in direction downwardly of the tubes which have an upright orientation. The purpose is to increase the flow speed of the medium flowing through the tubes, in the lower region of the same. Subdividing the tubes in this manner, namely into a plurality of separate channels which are arranged behind one another with reference to the direction in which the cooling air flows about the tubes, has the disadvantage that these flattened tubes act in their lower region analogously to completely separate tubes arranged behind one another in the flow direction of the cooling air, because there is no constant pressure equalization between the individual channels in the interior of the respective tube. As a result of this, the steam in the channel which is so located that it is cooled first by the impinging air, will be cooled substantially more than the steam in the subsequent channels because the air has already been heated by the time it reaches the subsequent channels. This means that in the channel or channels where the cooling effect is greatest, there is danger that condensate might be cooled too much, and might actually reach a freezing point.

Additionally, this prior-art construction is provided with further installations accommodated in the tubes, located above the outflow for the condensate which extends over only a small portion of the lower tube cross section of the flat tubes. These additional installations are again in form of substantially V-shaped divider walls which extend over the major part of the largest cross-sectional dimension of the tube, and over the entire dimension transversely thereof, that is over the major part of the length and over the entire part of the width of the tube cross section. The purpose of these divider walls is to cause a flow direction of the medium which flows through the tubes, and to assure that there will be a sufficient flow speed up to the condensate outlet. Moreover, a direct entry of steam into the condensate outlet is to be prevented by these walls. In addition, they have the purpose of supporting the parallel side walls with reference to one another, in order to prevent inward buckling of the side walls, particularly where a vacuum exists in the tubes. The disadvantage of this arrangement is that only a relatively small part of the tube cross section can be used for the steam flow and thus for the condensation, with dead zones developing between the arms of the V-shaped inserts in which undesirably low cooling temperatures will be reached. In this region, air cushions develop which, particularly at low exterior temperatures, so cool the divider walls with which they are in contact that these walls, in turn, significantly undercool the condensate which flows over them, and may even cause it to turn to ice. Moreover, the progressively increasing construction of the tube cross section in the downward direction of the respective tubes, causes the danger that the steam might become blocked or that air cushions might develop, with the result, again, that the condensate might become excessively cooled. This results in high heat losses and a reduction of the condensation effectiveness, an increase in the danger of corrosion because the condensate can now absorb more oxygen, and can even lead to icing-up of the condesate tubes in their lower regions.

Aside from all this, there is a practical consideration which makes the use of this type of rectangular cross section tube undesirable, because they are difficult to manufacture. In particular, they cannot be produced in significant length with the relatively narrow tolerances which are required to be able to provide the tubes with heat-exchange fins. In addition, they have a very small cross-sectional stability because the side walls which extend parallel to one another can readily be bulged inwardly if and when a vacuum develops in the tubes, unless they are supported by interior installations which, however, have the disadvantages outlined above. The manufacture of such flat tubes is particularly difficult because due to their low stability, they tend to twist or otherwise become deformed during manufacture. Tinning, which is frequently used for heat-exchange tubes having fins, can be carried out only with difficulty with tubes of this particular cross section, because the side walls which extend in parallelism to one another can become deformed as a result of this. Finally, these tubes cannot be provided with heat-exchange fins with the equipment that is currently available on the market for automatic application of such fins, because in the manufacture of such tubes it is unavoidable that relatively large tolerance variations will occur, which means that either the heat-exchange fins cannot be applied by machine due to the excessively high friction if the tolerance is too great, or they will not be properly seated and will be loose if the tolerance variation is on the low side.

For the aforementioned reasons, air cooled surface condensers of the type described above have never become popular in the industry and are not used in practice.

Instead, it is the current practice to use air cooled surface condensers for condensation of water vapors, chemical vapors or the like, having three or more, for instance five or six, rows of tubes which are arranged behind one another as seen with repect to the direction of cooling air flow. These tubes are provided with fins and are usually connected so that several of them form a condenser element. The condenser elements are arranged in groups adjacent one another, and are supplied with steam from one or more steam distributor conduits. The condensate which develops in the condenser elements is withdrawn through one or more condensate collecting conduits, whereas the gases which cannot be condensed, usually primarily air, are withdrawn through one or more suction conduits. The condensate tubes can be connected directly to steam distributor chambers, condensate collecting chambers or air withdrawing conduits. In many cases, the condensate tubes are connected at their ends with chambers which, in turn, are connected with steam distributor chambers, condensate collecting chambers or air withdrawal conduits. The finned tubes of each element are connected in parallelism with one another, and usually a group of condenser elements has cooling air blown against it by one or more blowers. The condenser elements can be arranged vertically, horizontally or inclined between these two positions. In most instances, the condenser elements are inclined somewhere between the vertical and the horizontal and are usually arranged to form an essentially roof-shaped configuration.

The tubes in these condenser elements are usually of a circular cross section, or of an elliptical or oval or otherwise shaped cross section which is elongated in the flow direction of the cooling air. The greatest inner-diameter dimension of the tube cross section, measured transversely to the cooling air flow, has a ratio of approximately 1:2 up to 1:4 with respect to the greatest inner cross section measured in the flow direction of the cooling air.

In order to obtain the largest possible heat exchange surface in the smallest possible area, these known condensers utilize several rows of cooling tubes which are arranged one behind the other in the direction of flow of the cooling air. This also aids in utilization of the available temperature differential between the cooling air temperature and the steam temperature. However, the arrangement has the disadvantage that the steam in the row of tubes which is first contacted by the cooling air will condense in a much shorter flow path than in the other rows of tubes, because of the greater temperature differential between the cooling air and steam temperature. This means that the condensation in this first row of tubes is completed at a greater distance from the end connected with the condensate collector than in the other rows of tubes. As a result of this, the condensate in this first row is under-cooled in undesirable manner over a relatively large portion of the tube length, and this leads not only to a substantial heat loss but also increases the capability of the condensate for absorbing oxygen and thus increases the danger of corrosion. Moreover, if the ambient temperatures are below freezing point, there is the danger that the condensate will freeze in the cooling tubes, leading to a clogging of these tubes and eventual damgage to the tubes. Even in some of the next-following rows of tubes there will be similar dead zones that are formed because the condensate is obtained at a significant distance from the condensate outlet, and here again the possibility of freezing of the condensate and freezing of the tubes cannot be precluded.

Various attempts have been made to overcome these problems, for instance by providing arrangements for throttling the steam inflow, in order to provide different quantities of steam into different rows of tubes depending upon whether they are in a position upstream or farther downstream with reference to the direction of cooling air flow. The quantity of steam would then decrease in the direction of cooling air flow i.e., consecutive rows of tubes would receive less steam. Another approach has been to provide the heat-exchange fins of different configuration on the tubes of the different rows, so that the fins will be progressively greater on the tubes of the various rows, in the direction of cooling air flow. However, neither of these proposals has been fully effective and the development of the disadvantages outlined above has not been supressed heretofore.

SUMMARY OF THE INVENTION

It is, accordingly, a general object of the present invention to overcome the disadvantages of the prior art.

More particularly, it is an object of the present invention to provide an air cooled surface condenser which is not possessed of these disadvantages.

Still more particularly, it is an object of the present invention to provide an air cooled surface condenser wherein the heat-exchange tubes have such cross-sectional configuration that the development of the aforementioned dead zones is avoided.

Still another object of the invention is to provide such a condenser wherein heat-exchange tubes are provided which can be readily produced in great lengths without requiring any installations in the interior for supporting their walls and/or for guiding the flow of medium therethrough.

An additional object of the invention is to provide such tubes which can be readily provided with heat-exchange fins by the use of existing fin-installing machinery.

In keeping with the above objects, and with others which will become apparent hereafter, one feature of the invention recites, in an air cooled surface condenser, in a combination which comprises a plurality of heat exchange tubes extending in one row of tubes transversely of the direction of air flow and each having an unobstructed interior. The interior has in one direction normal to the elongation of a respective tube a largest dimension which has a ratio of at least 6:1 with reference to another largest dimension normal to the one direction and to the elongation. The tube cross section is advantageously elliptical or oval and over the entire length of the tubes there are no installations in the interior of the tubes, such as divider walls, supporting elements or the like. The ratio may be between 6:1 and 6:12, and preferably is between substantially 7:1 and 10:1. Preferably the largest dimension of the inner cross-section of the tubes in the direction of air flow is at least six times as large as the largest dimension of the inner cross section of the tubes transversely of the direction of air flow.

By comparison to the existing finned tubes known from the prior art, a finned tube according to the present invention will have a ratio between its largest and smallest cross-sectional dimension which is approximately twice or three times as great as in the existing tubes. Because of this, it can serve to condense the same amount steam in a single tube as can be condensed in three or more tubes of the prior-art constructions.

Moreover, a tube according to the present invention has the advantage that at every point of the tube there will be a pressure equalization between all regions of the tube cross section, so that the condensation of the steam at that wall portion of the tube which faces the cooling air flow will be terminated exactly at the same position as at the wall portion of the same tube which faces away from the cooling air flow. The danger that dead zones might develop is significantly reduced because of this, especially by comparison with the existing prior-art tubes, and may even be completely eliminated. The ratio between the maximum and minimum cross-sectional dimension in the novel tube is substantially greater than that which is known from prior-art tubes of elliptical or oval cross section, and has the advantage that the flow speed losses by comparison with several tubes which are arranged one behind the other and the flow direction of the cooling air and that the same total cross section as a single tube of the present invention, amounts to a fraction of the flow speed losses experienced in the several prior-art tubes taken together. For instance, it can be reduced to less then a third of the losses of the combined prior-art tubes. This means that given the same throughput of steam, the speed of the steam can be reduced by almost half at the inlet into the tubes, or else if the speed at which the steam enters the tubes is the same as previous, substantially higher amounts of steam can be passed through the novel tube per unit of time.

Despite their particular cross section, the novel tubes according to the present invention have—quite surprisingly—a great cross-sectional stability and can be produced by rolling and/or drawing without difficulty, and in particular—and again surprisingly—without any danger that deformations or twisting might occur in the tubes. The stability of the cross section is so great that the tubes according to the present invention can also be readily tinned or otherwise heat treated, without having to fear any twisting or the like. The outwardly bulging side walls of the tubes according to the present invention will not collapse even if a vacuum develops in the interior of the tube, so that no installations are required within the tube to prevent such collapse.

The novel tube can be readily provided with heat-exchange fins by means of existing machines which apply such fins, even if the tubes have great lengths of, for instance, 10 meters or more. The outwardly bowed side walls of the tubes will springily yield somewhat as the fins are applied, and subsequently spring back to their original position and hold the fins tightly in place, aside from which they assure a particularly good heat-exchange contact with the fins. Moreover, the novel tube can be produced at reasonable expense with the necessary precision, that is the relatively narrow tolerances required for the application of the fins by machine can be readily maintained in producing these tubes without undue expenses, and no inner internal supports are ever required.

If the aforementioned ratio becomes significantly greater than 10:1, a production of the novel tube with the necessary narrow tolerances becomes more difficult, and the danger that they might twist or otherwise deform, for instance during tinning or heat treating, increases. Moreover, the cross-sectional stability of the tube decreases also, so that it is advantageous that the ratio should not exceed 12:1.

If in individual tubes small dead zones should develop at the lower tube end, keeping in mind that the tubes will have an upright orientation when in use, then these zones will be significantly smaller than the ones which develop in all the known air cooled surface condensers, and in order to completely eliminate these small dead zones it is merely necessary to connect these condenser tubes with some dephlegmatory finned tubes, so that the portion of the condenser which operates in a dephlegmatory manner can be substantially smaller than in the known surface condensers using a KD-circuit. Generally speaking, it is sufficient if the condenser tubes have less than 10%, for instance 3–5% of the total steam which is supplied to the condenser, withdrawn from them and supplied via a connecting conduit to the dephlegmatory tubes. These tubes can, of course, also be constructed in accordance with the present invention but will be connected in accordance with the dephlegmatory principle which is well known. Moreover, the tubes according to the present invention can, of course, also be used in full dephlegmatory installations, in which the lower end chambers act both as steam distributors and condensate collecting chambers, whereas the upper end chambers are connected to an air withdrawal conduit or device.

A further significant advantage of the tubes according to the present invention is the fact that they will be self-supporting even if they have a relatively great length, for instance 6–10 meters. This has the advantage that the supporting constructions previously necessary in surface cooled condensers can be eliminated. Because this amounts to an elimination of approximately 20–25% of the total weight of the condenser element, it not only represents a significant weight reduction and material savings, but also makes it possible to enlarge the surface area which is available for heat exchange purposes by approximately 8–10% with respect to the prior-art constructions where this much of the surface area was obstructed by the supporting structures. The tubes according to the present invention are self-supporting because of their cross section, and because of their substantially greater resistance to bending and defomation. This is particularly advantageous because the weight of the heat-exchange fins which are applied to the tubes is relatively substantial. Because these tubes are usually arranged in a roof-shaped or inverted-V-shaped arrangement, the self-supporting characteristic has the further advantage that even if the tubes have a length of for instance 6–10 meters and are inclined in the aforementioned manner, they will not hang through or bend.

In some instances it may be desirable to provide sheet-material spaces which are spaced from one another by a significant distance, for instance 1 meter, which engage adjacent tubes and maintain them at desired spacing from one another. These spaces may have cutouts in which the respective tubes are lodged, and this provision completely eliminates the already inherently small possibility that bending of the tubes might occur. Such spaces can be produced very readily and their weight is only a small fraction of that required for the supporting structures of the prior art. It is advantageous if the cutouts in the spaces embrace the tubes only approximately over half their cross section. The heat-exchange fins on the tubes may have portions which engage the spaces and hold them in position.

It has been found particularly advantageous if the cross section of the tubes according to the present invention is such that it is bounded by two approximately semi-circular wall portions and by two additional wall portions which are joined or merge with the semi-circular wall portions and the spacing between which increases continuously from their juction with the respective semi-circular wall portion to the longitudinal center axis of the tube. It is particulary advantageous if the spacing between these additional wall portions in the region of the center axis is approximately twice as great as in the region where they merge with the semi-circular wall portions. A tube of such a cross section has great stability and can be produced by rolling and/or drawing without danger at all that it might twist or otherwise become deformed. It is completely self-supporting even if it has a great length, for instance 10 meters or more, so that no supporting structures are required.

A further disadvantage of the prior-art air cooled surface condensers has been that the ends of the tubes had to be connected with bottoms which were formed with stampedout openings in exact correspondence with the cross section of each individual tube which entered into it. Each tube, of course, had to be carefully inserted into these openings which was difficult, especially if the tube was of great length. If the tubes were steel tubes, they had to be welded individually to the bottoms, and if the tubes were copper or brass they had to be connected with the bottoms by rolling. In the case of aluminum tubes they had to be carefully sealed by means of sealing rings with respect to the bottoms.

The present invention avoids all this by proposing that the tube end portions can be enlarged to from substantially prismatic chambers the outer ends of which are of approximately rectangular cross section. These chambers are so arranged that the adjacent edges of the outer ends are in contact and are gas-tightly connected with one another, preferably by welding. The outer edges can be directly connected with a steam distributor conduit or with a condensate collector conduit, again by welding or by screw threaded connections or the like. This eliminates the bottoms previously required, because now the tube end portions can be directly connected with a steam distributor or steam condensate collecting chamber, and in many instances it is even possible to connect the outer edges gas tightly directly with a steam pipe or with a condensate removal pipe so that even the previously required separate end chambers can be completely omitted, their functions being assumed by the enlarged end portions of the tubes themselves.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 5:
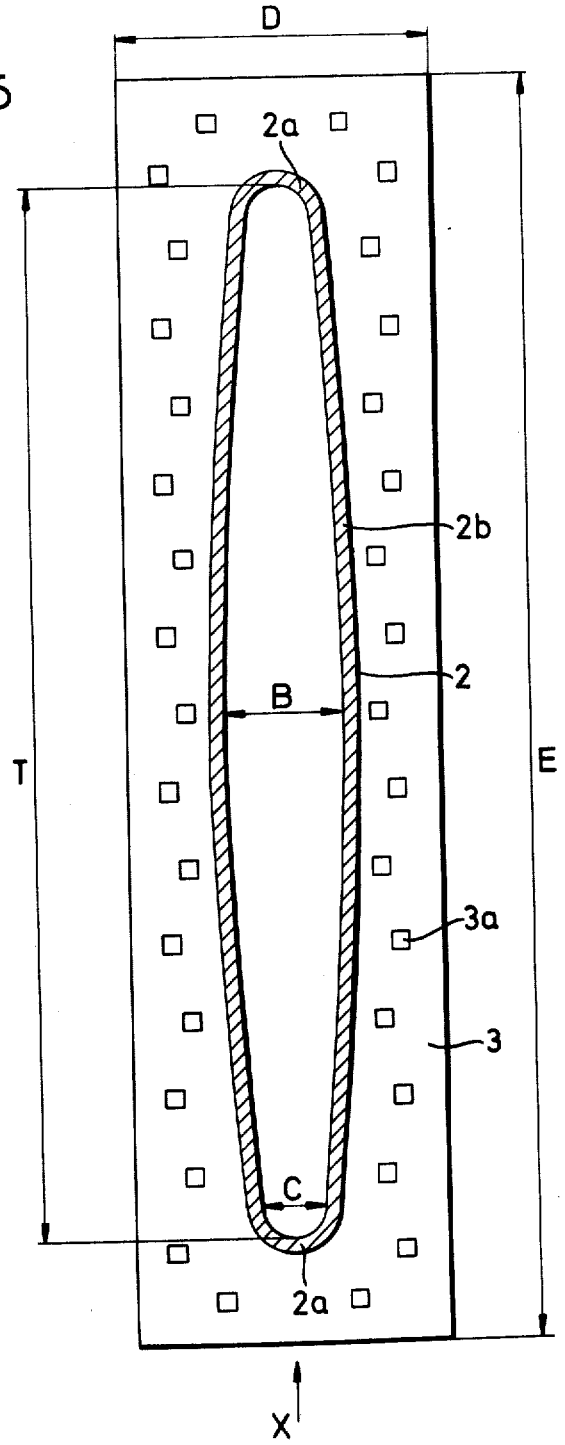
FIG. 5 is a cross section through a tube of the condenser shown in the preceding FIGURES.

Discussing now the drawing in detail, and firstly referring to the embodiment in FIGS. 1–5, it will be seen that each condenser element is composed of a large number –for instance 50—of finned tubes 2 which extend transversely to the flow direction $x$ of the cooling air and are arranged in a single row. One of these tubes is shown in FIG. 5 in cross section. The finned tubes 2 have a cross section the maximum dimension T of which is at least six times as great as the transverse direction B. In the embodiment shown in FIG. 5, the ratio between T and B is approximately 9:1.

As shown in the drawing, including FIG. 5, the cross section of these finned tubes 2 in this embodiment is delimited by two approximately semi-circular wall portions 2*a* and two additional wall portions 2*b*. The inner distance between the wall portions 2*b* increases from their juncture with the wall portions 2*a* up to the longitudinal center axis of the tube, and the distance B of the wall portions 2*b* in the region of the center axis of the tube is approximately twice as great as in the region where they join with the wall portions 2*a*, that is the region where the distance is designated with reference character C. The dimension T in the embodiment of FIG. 5 is 175 mm, whereas the dimension B is 20 mm. The wall thickness of the tube is 2.5 mm and the entire cross-sectional area of the tube is 28 $cm^2$. This is, of course, by way of example.

Each of the finned tubes 2 is provided with heat-exchange fins 3 which extend transversely of the respective tube and are spaced by a small distance from one another in direction axially of the tube. In this embodiment, the fins 3 are of rectangular cross section but of course the cross section could be different. The width D of the fins is larger by approximately 30–35 mm than the dimension B of the tube 2, whereas the length E of the fins 3 is larger by approximately 35–40 mm than the dimension T of the tube 2. The fins 3 are provided with a relatively large number of embossments 3*a* for reinforcing purposes.

Figure 6:
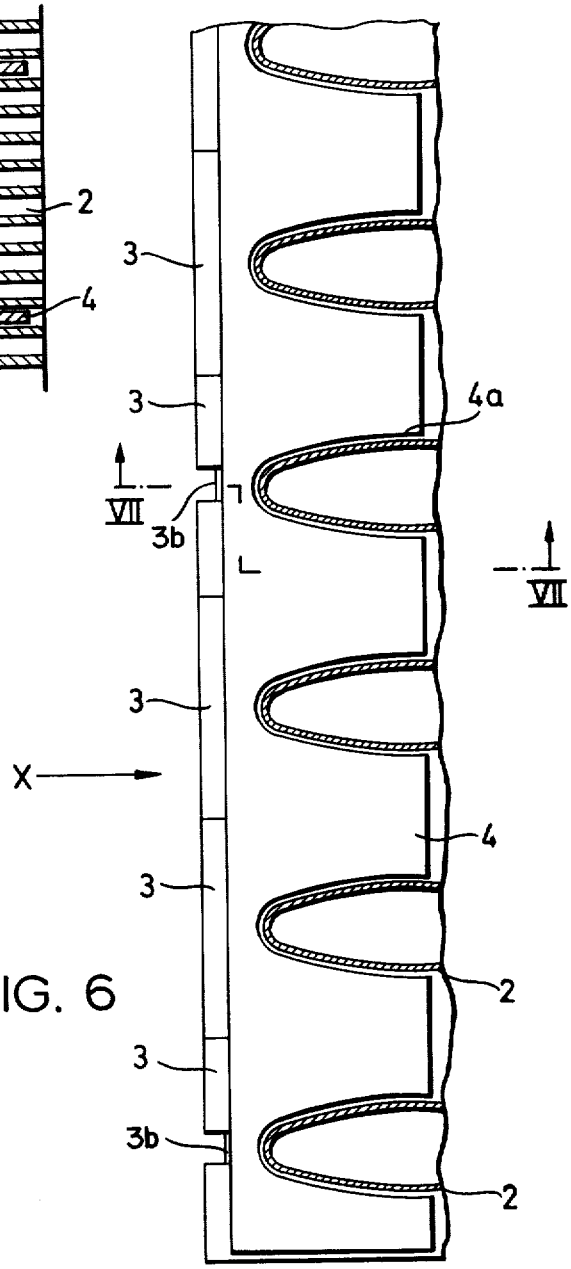
FIG. 6 is a cross section through a condenser element with a spacer member.

At distances of approximately 1 meter in longitudinal direction, the finned tubes 2 are spaced from one another by spacer members 4 which are provided with cutouts 4*a* corresponding to the cross section of the tubes 2, which cutouts embrace the respective tubes 2 only approximately over half the cross section of the respective tubes, shown in FIG. 6. At the narrower sides of the fins 3 the latter are provided with portions 4*b* which are bent outwardly and embrace the outer edge of the spacer members 4 so as to maintain the same in position. The portions 4*b* are arranged at the middle of the narrower side of the fins 3 and have a width which corresponds to only a fraction of the width of the narrower side. Of course, the arrangement could be different from what has been illustrated.

Figure 1:
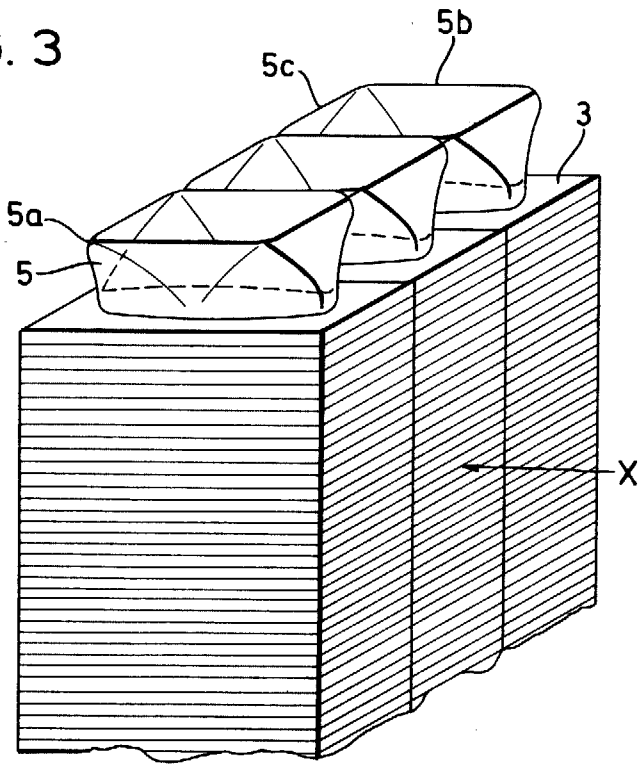
FIG. 1 is a diagrammatic fragmentary perspective of a condenser element according to the present invention.
Figure 3:
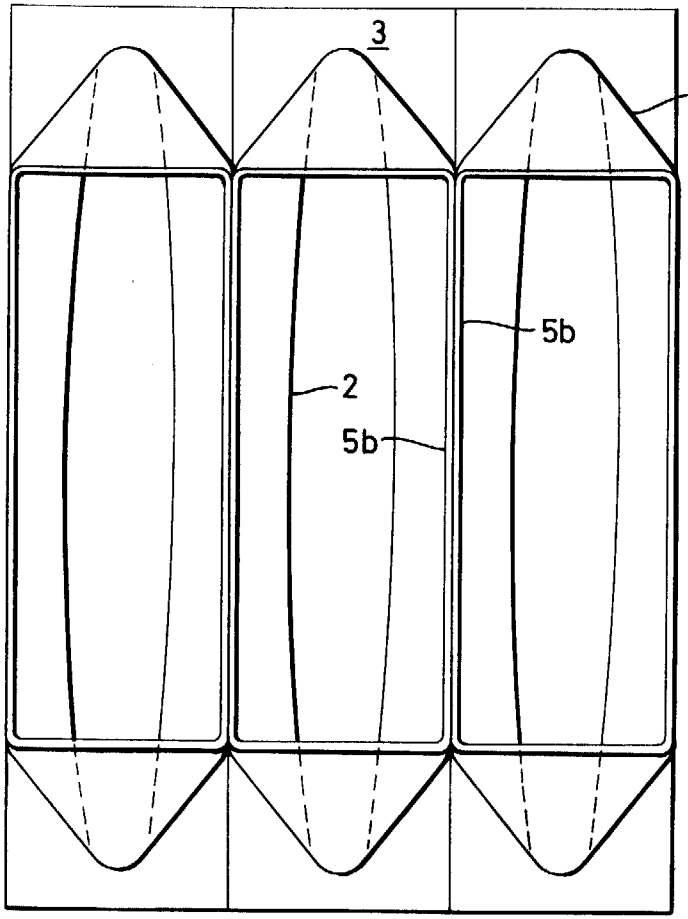
FIG. 3 is a top-plan view of FIG. 1.
Figure 4:
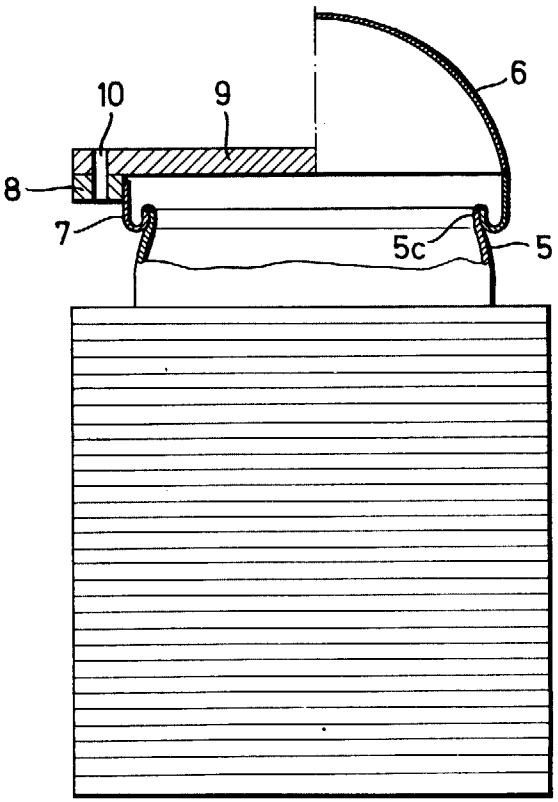
FIG. 4 is a partly sectioned side view of FIG. 2.
Figure 2:
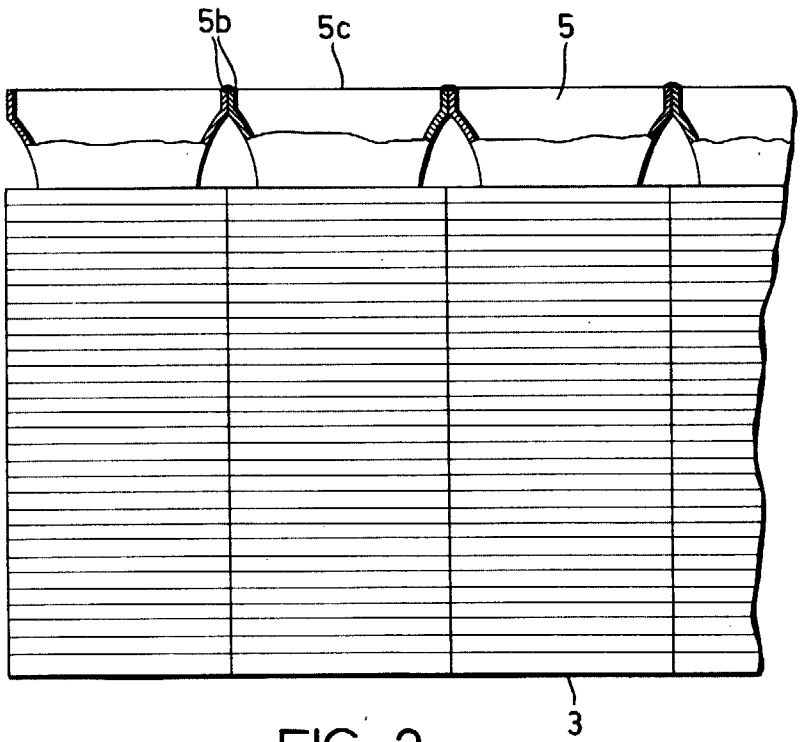
FIG. 2 is a front view of FIG. 1, partly in section.

FIGS. 1—4 show clearly that the ends of the tubes, at the upper and lower ends, are enlarged to form substantially prismatic chambers 5. The outer ends 5*a* are of rectangular cross section. The facing edges 5*b* of these chambers 5 are in contact and are gas-tightly connected with one another, for instance by welding as shown in FIG. 2. Connected to the outer edges may be either a terminal chamber 6 which is a steam distributor chamber or a condensate collector chamber, and which is secured by welding as shown at the right-hand side of FIG. 4. For this purpose, the lower end of the chamber 6 is bent inwardly and is welded to the outer edges of the respective chamber 5, along the edges 5*b* and 5*c*. At the left-hand side of FIG. 4 I have shown a further possibility which, it should be understood, can be used separately or in conjunction with the possibility shown at the right-hand side. The possibility shown at the left-hand side is that a sheet metal collar 7 is connected with the edges 5*b* and 5*c*, for instance by welding after first bending its lower end inwardly. The collar 7 is welded to a flange 8 which can be connected by means of screws 10 to a bottom 9 which closes the chambers 5 in upward direction. Steam supply conduits, condensate outflow conduits and/or air withdrawal conduits can then be gas-tightly welded into the bottom 9, these possibilities not being shown in FIG. 4 because they are entirely conventional.

Figure 7:
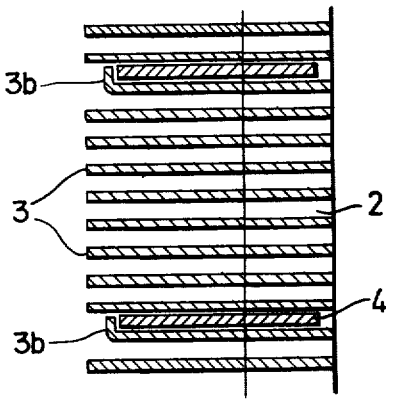
FIG. 7 is a section taken on line VII—VII of FIG. 6.

The only connection between the finned tubes 2 are the spacing members 4 shown in FIGS. 6 and 7, and the fact that at the upper and lower end portions where the chambers 5 are formed, the tubes are connected with various conduits or end chambers, as described above. This means that the tubes 2 are self-supporting, due to their cross-sectional configuration, and condenser elements whose tubes 2 have an even very large length, for instance between 6–10 meters or even more, will thus be self-supporting without requiring any supporting structures whatsoever. The advantages of this have already been outlined earlier.

Figure 9:
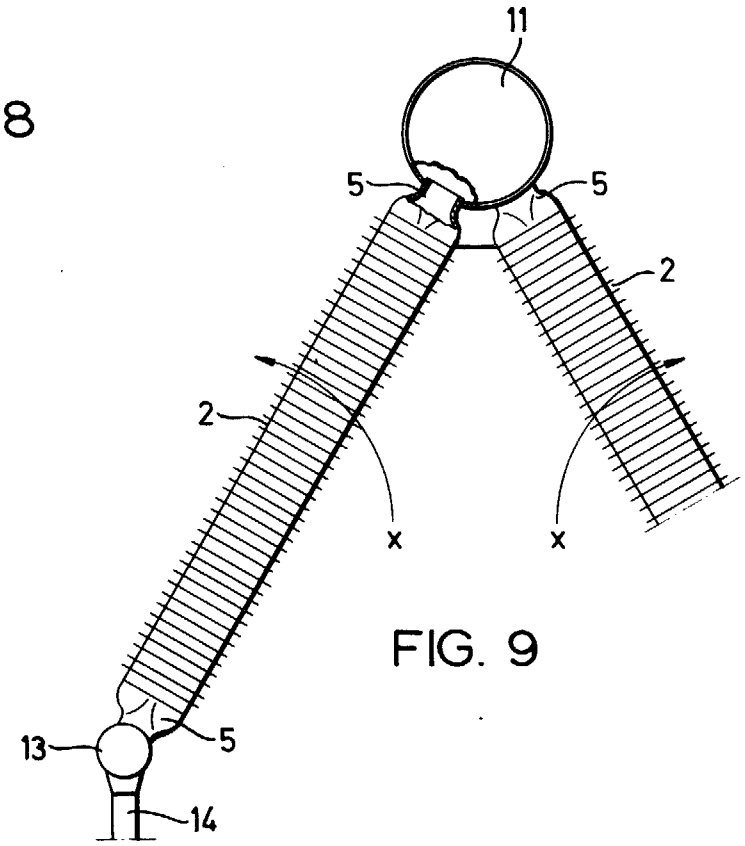
FIG. 9 is a section taken on line IX—IX of FIG. 8.
Figure 8:
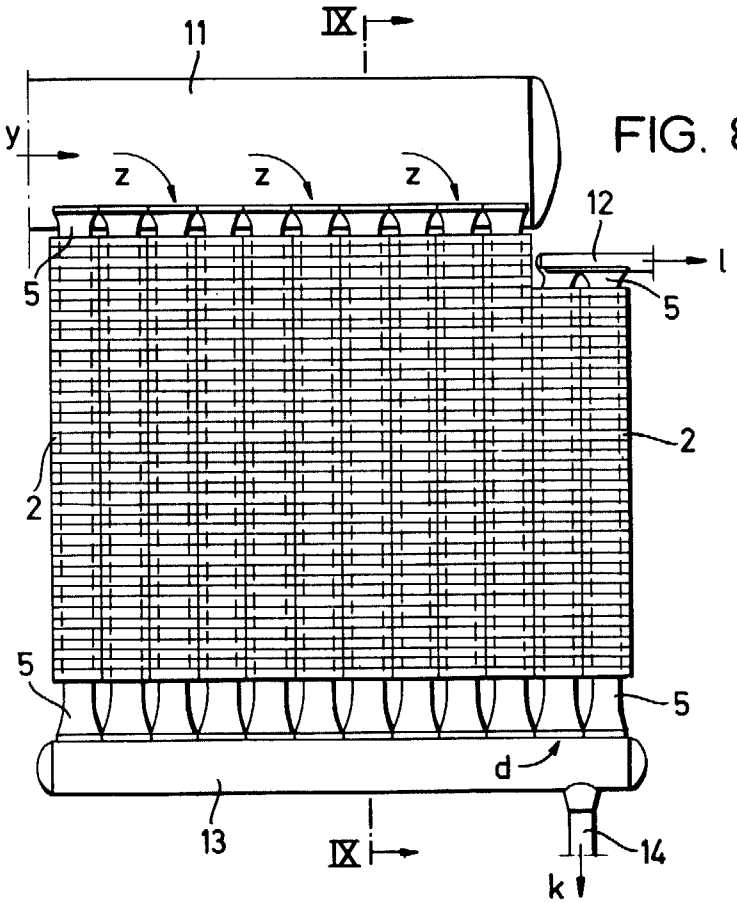
FIG. 8 is a diagrammatic illustration in side view, shown fragmentarily of a condenser according to the present invention.

Coming now to FIGS. 8 and 9 it will be seen that these show a surface condenser according to the present invention wherein a relatively large number of finned tubes 2 is arranged in a row extending transversely to the flow direction X of the cooling air. The tubes 2 are predominantly directly connected with their prismatic upper chambers 5 to a steam distributor conduit 11. Two of the tubes 2 are connected with their upper chambers 5 directly to an air withdrawing conduit 12. The lower chambers 5 of all of the tubes 2 of the row are connected to a condensate collecting conduit 13 of large cross section, which at the same times serves as a steam overflow conduit.

FIG. 9 shows an arrangement in which two rows of finned tubes 2 are arranged in a roof-shaped manner, that is in form essentially of an inverted V. They are connected to a common steam distributor conduit 12 and the lower chambers 5 of the tubes 2 which are spaced from one another are connected to two spaced condensate collecting conduits 13 of a large cross section. Approximately at the bases of the equilateral triangle formed by the tubes 2 of the two rows there are provided blowers (not illustrated) which produce a flow of cooling air that impinges upon the tubes 2 in the direction of the arrow *x*.

The steam to be condensed flows through the steam distributor conduit 11 in the direction *y* and enters in the direction *z* into the upper chambers 5 of the tubes 2 which are connected with the conduit 11. The tubes 2 are connected with one another to form a condenser, and more than 90% of the total steam quantity is condensed in them. The condensate is withdrawn via the collecting conduit 13 and the outflow 14 in the direction of the arrow *k*.

The portion of the steam which is not yet condensed in the tubes 2, namely less than 10% of the total steam quantity, is supplied in the direction of the arrow *d* into further finned tubes 2 which are connected in dephlegmatory manner in which this remainder of the steam also condenses. From these latter finned tubes 2 the condensate flows into the conduit 13 to be removed from the same from the outlet 14 in the direction *k*. The gases, particularly air which cannot be condensed, are withdrawn via the conduit 12 in the direction of the arrow 1, by means of a non-illustrated suction device.

It will be understood that each of the elements described above, or two or more together, may also find a useful application in other types of constructions differing from the type described above.

While the invention has been illustrated and described as embodied in an air cooled surface condenser, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific asepcts of this invention and, therefore, such adaptations should and are intended to be comprehended within the meaning and range of equivalence of the following claims.

What is claimed as new and desired to be protected by Letters Patent is set forth in the appended claims:

1. In an air-cooled surface condenser, a combination comprising a plurality of heat-exchange tubes which extend in a single row transverse to the direction of air flow, each of said tubes having an elliptical or oval interior cross-section which is unobstructed over the entire length of the tube and which is elongated in said direction of air flow, the maximum longitudinal dimension of said interior cross-section being a multiple of the maximum transverse dimension thereof and having relative to the latter a ratio of at least 6:1 and at most 12:1; a plurality of closely spaced transverse heat-exchange fins applied on the exterior of each of said tubes; and fluid-conducting conduit means communicating at least indirectly with the opposite end portions of the respective tubes.

2. A combination as defined in claim 1, said tubes having an inner diameter which is bounded by two substantially semi-circular wall portions and by two additional wall portions the distance between which latter increases continuously in direction away from a juncture of the respective wall portion with one of said semi-circular wall portions.

3. A combination as defined in claim 2, wherein said distance is substantially twice in great as the region of the tube center axis than in the region of the respective junctures.

4. A combination as defined in claim 1, said tubes having a substantial length in excess of about 6 m, and the cross section of said tubes being so selected that said tubes are self-supporting despite said substantial length.

5. A combination as defined in claim 1, said tubes extending in parallelism and being unsupported intermediate their end portions; and further comprising sheet material spacer members extending between respective tubes and having cutouts through which said tubes extend, said spacer members embracing the respective tubes located in said cutouts over substantially half the circumference of the tube.

6. A combination as defined in claim 1, wherein said tubes have enlarged-diameter end portions forming prismatic chambers which have outer edges defining a substantially rectangular outline, the outer edges of adjacent ones of said tubes abutting one another and being gas-tightly joined by welding.

7. A combination as defined in claim 6, wherein said outer edges are gas-tightly connected with steam distributing or condensate collecting chambers.

8. A combination as defined in claim 6, wherein said outer edges are connected with steam pipe or condensate pipes in fluid-tight relationship.

9. In an air-cooled surface condenser, a combination comprising a plurality of parallel heat-exchange tubes which extend in one row transversely of the direction of air flow and are each unsupported intermediate their end portions, said tubes each having an unobstructed interior having in one direction normal to the elongation of the respective tube a largest dimension which has a ratio of at least 6:1 with reference to another largest dimension that is normal to said one direction and to said elongation; sheet material spacer members extending between respective ones of said tubes and having cutouts through which said tubes extend; and transverse heat-exchange fins provided on said tubes and some of which have portions engaging a respective spacer member.

* * * * *